United States Patent [19]

Carlson

[11] Patent Number: 4,625,422

[45] Date of Patent: Dec. 2, 1986

[54] ARCHERY BOW SIGHT MOUNTED ON THE BOW STRING AND METHOD OF MAKING SAME

[76] Inventor: Charles W. Carlson, 2811 - 13 Mile Rd., Rockford, Mich. 49341

[21] Appl. No.: 786,665

[22] Filed: Oct. 11, 1985

[51] Int. Cl.[4] ..... F41B 5/00; F41G 1/00

[52] U.S. Cl. ..... 33/265; 124/87

[58] Field of Search ..... 33/265; 124/87, 90

[56] References Cited

U.S. PATENT DOCUMENTS

| | | | |
|---|---|---|---|
| 3,410,644 | 11/1968 | McLendon | 33/265 X |
| 3,703,770 | 11/1972 | Sofield | 33/265 |
| 3,703,771 | 11/1972 | Saunders | 33/265 |
| 3,859,733 | 1/1975 | Chesnick | 33/265 |
| 4,011,853 | 3/1977 | Fletcher | 33/265 X |
| 4,116,194 | 9/1978 | Topel | 33/265 X |

*Primary Examiner*—William D. Martin, Jr.

*Attorney, Agent, or Firm*—Varnum, Riddering, Schmidt & Howlett

[57] ABSTRACT

A bow sight 10 is adapted for use with an archery bow 14 provide targeting accuracy. The bow sight 10 includes a frame portion 18 having channels 26 at the outer edges thereof adapted to secure the bow sight 10 between strands of the bow string. The frame portion 18 also has a relatively large open central area 20. Front and rear inserts 30, 32 integrally molded within the frame portion to provide strength and rigidity to the bow sight 10, and have relatively large central apertures 34, 36 extending therethrough. The large open central area 20 of the frame portion 18 and the large central apertures 34, 36 of the front and rear inserts together define a composite window 38 through which the archer may view the target. An aiming dot 40 is secured by means of arms 42 within the central portion of the composite window to provide an aiming point within the archer's line of vision.

19 Claims, 5 Drawing Figures

ARCHERY BOW SIGHT MOUNTED ON THE BOW STRING AND METHOD OF MAKING SAME

DESCRIPTION

1. Technical Field

This invention relates to archery equipment and, more particularly, relates to bow sights mountable on bow strings.

2. Background Art

Archers have long been using sighting apparatus for improving their shooting or targeting accuracy. Various forms of sighting apparatus include pin sights, telescopic sights, and similar apparatus mounted to the body of the bow. These forms of bow-mounted sighting apparatus have not been entirely acceptable, in part because of the distance between the sighting apparatus mounted on the bow and the aiming eye of the archer. Certain bow sights seek to overcome this drawback by mounting a sighting eye piece on an arm extending rearward from the body of the bow. The archer then sights the target through the arm-mounted eye piece, typically in conjunction with further pin sights or telescopic sights mounted on the body of the bow. This type of bow sight has certain additional disadvantages, including increased weight of the bow, and balance and wind resistance problems caused by the arm extending rearward from the bow.

Certain of the disadvantages of the arm-mounted bow sight have been avoided by mounting bow sights on the bow string itself. The sights so mounted are utilized either alone or in conjunction with further sighting equipment mounted on the body of the bow. Known bow string-mounted bow sights include the type known as peep sights. In these sights, a piece typically having a sighting hole is mounted between strands of the bow string a fixed distance above a nocking point, or fixed point on the bow string. As an example, the U.S. Pat. No. to Fletcher 4,011,853, issued Mar. 15, 1977 describes one type of archery peep sight. The Fletcher peep sight there is in the form of a disc secured between strands of the bow string having a frusto-conical surface disposed inwardly from a first surface of the disc and a semi-conical recess formed in the second surface of the disc. The sight opening is formed out of a portion of the disc of reduced thickness.

One drawback of the use of peep sights mounted to the bow string has been the tendency of the sight to become vertically misaligned with respect to the line of sight of the archer as the bow string is drawn. A means typically utilized to negate this effect has been to bore the sight opening at an angle relative to the bow string so that the sight opening aligns with the archer's line of sight and the target only when the bow string is fully drawn. An example of this type of angled sight is shown in the Chesnick U.S. Pat. No. 3,859,733, issued Jan. 14, 1975, where the body portion of the sight when mounted on the bow string will align the sight opening at an angle with the bow string so that the sight opening will extend along the line of sight of the archer.

The mounting of the typical peep sight between strands of the bow string may also cause the sight to tend to rotate axially away from the target. The Topel U.S. Pat. No. 4,116,194, issued Sept. 26, 1978 shows a bow sight which constrains this rotational tendency by means of an elastic cord connecting the bow sight to the body of the bow.

A drawback of these conventional peep sights mounted to the bow string is that the sight opening itself is typically of very small diameter. The small bore of the sight opening is such that a slight movement of the bow or archer during targeting will cause the target to pass out of the archer's line of sight. The small sight opening also causes difficulty by preventing the archer from relocating the target easily. The archer is thereby forced to look away from the bow sight to relocate the target. In addition, a conventional peep sight is not usable in dim light conditions because the small sight opening does not admit sufficient light.

DISCLOSURE OF THE INVENTION

In accordance with the invention, a bow sight is adapted for use with an archery bow and for mounting on a bow string and comprises a frame portion having an open central area for targeting or sighting and having channels at the outer edges of the frame adapted to receive strands of the bow string; a front insert means having a front central aperture secured within the front portion of the frame; a rear insert means having a rear central aperture secured within the rear portion of the frame; an aiming dot means secured by arms within a composite window defined by the frame and inserts; and a mounting piece attached to, or integral with, the frame.

The frame portion is formed of injection molded plastic and is of elongated, somewhat elliptical shape. The central open area is of slightly smaller but similar elongated, somewhat elliptical shape and, therefore, is relatively large with respect to the overall size of the frame portion. The front and rear inserts are flat metallic pieces of elongated, somewhat elliptical shape having central apertures extending therethrough of slightly smaller but similar elongated, somewhat elliptical shape. The inserts provide strength and rigidity to the bow sight and are secured in the frame during the injection molding process. The aiming dot is secured within the composite window by arms to provide a point which the archer can align with the target. The large size of the composite window and the small size of the aiming dot achieves an advantageous result in that a small movement of the bow or archer, while perhaps causing the target to "drift" from the aiming dot, will not cause the target to disappear totally from the composite window. The archer may easily make the necessary correction to realign the timing dot with the target without the necessity of looking away from the bow sight to relocate the target. The aiming dot is of rectangular configuration and is brightly colored, thereby improving the targeting accuracy of the bow sight, especially in low light intensity environments due to the high visability of the brightly colored rectangle.

The bow sight is formed by securing the front and rear inserts and the arms securing the aiming dot in place within the framed portion during the injection molding of the frame. The mounting piece may also be formed as an integral part of the frame portion during this molding step. Thus, the bow sight may be easily and economically formed in what comprises essentially a one-step molding process. The bow sight thus formed is simple in structure and is light weight so that it does not hamper the normal operation of the bow string. It is also easily mountable on the bow string at the preferred location, and, if desired, the position of the bow sight may easily be changed by moving its location on the bow string.

BRIEF DESCRIPTION OF THE DRAWINGS

The invention will now be described with reference to the drawings in which.

BEST MODE FOR CARRYING OUT THE INVENTION

Figure 1:
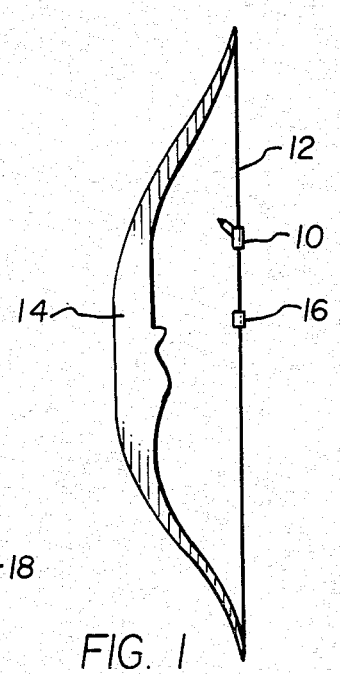
FIG. 1 is a perspective view showing a bow sight according to the invention mounted on a bow.

Referring to the drawings, and particularly FIG. 1, a bow sight 10 according to the invention is mounted on a bow string 12 which is, in turn, mounted on a conventional archery bow 14. The bow sight 10 can be utilized with virtually any type of conventional bow and, accordingly, the bow 14 depicted in FIG. 1 does not form the basis of any patentable features of the invention. It should be emphasized, however, that the bow sight 10 in accordance with the invention is suitable for use not only with simple bows, but also with compound bows utilizing the commonly known elaborate pully and cable systems for purposes of achieving optimum drawstring tension.

The bow string 12 may be provided with a conventional nocking point 16, i.e. a fixed point on the bow string where the rear end of the arrow shaft (not shown) is typically engaged. The bow sight 10 is typically mounted on the bow string 12 a fixed distance above the nocking point 16.

Figure 2:
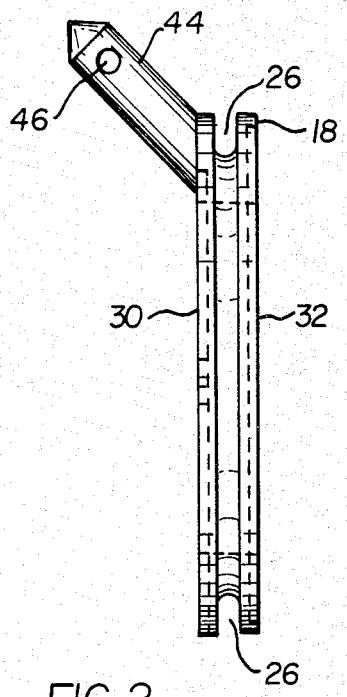
FIG. 2 is a side view of the bow sight shown in FIG. 1.
Figure 3:
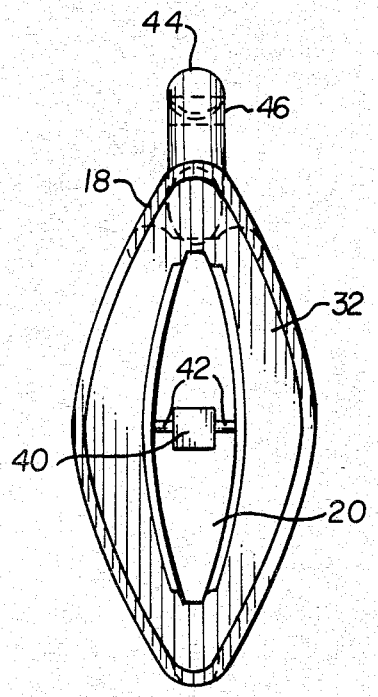
FIG. 3 is a rear view of the bow sight taken along line 3—3 of FIG. 2.
Figure 4:
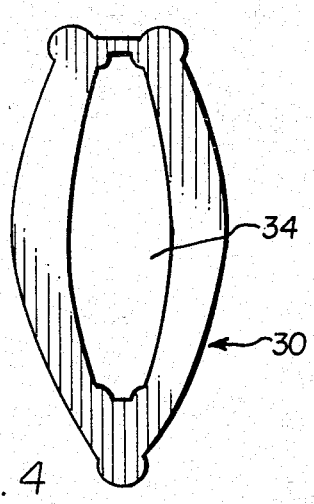
FIG. 4 is a front view of a front insert of the bow sight.

As shown in FIGS. 2 and 3, the bow sight 10 includes an elongated and somewhat elliptical-shaped frame portion 18 preferably constructed of a plastic material and having a front section 19, a rear section 21, and a central section 23. The frame portion 18 has an open central area 20 of a similar elongated and somewhat elliptical shape. The size of the open central area 20 is slightly less than the overall size of the frame portion 18 so that the open central area 20 is relatively large with respect to the bow sight 10. The open central area 20 extends through the frame portion 18 so that the frame portion has both inner surface edges and outer surface edges. Channels 26 of arcuate configuration are formed on the outer surface edges and are adapted to engage strands of the bow string 12. The bow sight 10 is mounted on the bow string 12 by separating the strands of the bow string 12 and inserting the frame portion 18 between the strands. The strands are then released and thereby engage the channels 26, securing the bow sight 10 in place on the bow string 12.

As shown in FIGS. 2–5, a front insert 30 and a rear insert 32 are provided to give rigidity and strength to the bow sight 10. Both the front insert 30 and the rear insert 32 are preferably formed from substantially flat pieces of metal. As specifically shown in FIG. 4, the front insert 30 is of elongated and somewhat elliptical shape and has a front central aperture 34 that is somewhat smaller but of similar elongated, somewhat elliptical shape. The major axis of the front central aperture 34 lies along the major axis of the front insert 30 and the minor axis of the front central aperture 34 lies along the minor axis of the front insert 30. The configuration is such that the size of the front central aperture 34 is relatively large with respect to the size of the front insert 30.

Figure 5:
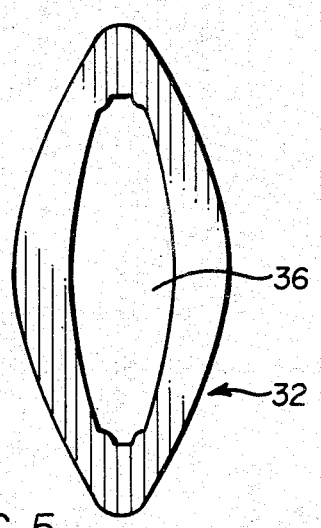
FIG. 5 is a rear view of a rear insert of the bow sight.

As shown in FIG. 5, the rear insert 32 is of an elongated and somewhat elliptical shape, and has a rear central aperture 36 of a smaller size but similar elongated and somewhat elliptical shape. The major axis of the rear central aperture 36 lies along the major axis of the rear insert 32 and the minor axis of the rear central aperture 36 lies along the minor axis of the rear insert 32. The configuration of the rear central aperture is such that the size of the rear central aperture 36 is relatively large with respect to the size of the rear insert 32.

Referring to FIGS. 2 and 3, the front insert 30 is secured within the frame portion 18 adjacent to the front surface of the frame portion 18 and in a vertical plane parallel to the front surface of the frame portion 18. The rear insert 32 is secured within the frame portion 18 adjacent to the rear surface of the frame portion and in a vertical plane parallel to the parallel planes containing the front insert, the front surface of the frame portion 18, and the rear surface of the frame portion 18. Both the front insert 30 and the rear insert 32 are preferably secured within the frame portion 18 by means of injection molding the frame portion 18 around the inserts. The alignment of the frame portion 18 and the inserts 30, 32 is such that the open central area 20, the front central aperture 34, and the rear central aperture 36 together form a composite window 38 through which the archer may view the target. The configuration of the composite window 38 is such that its size is relatively large with respect to the overall size of the bow sight 10.

The bow sight 10 further includes an aiming dot 40 having a rectangular configuration. The aiming dot 40 is preferably brightly-colored and mounted in the same vertical plane as the front insert 30 by arms 42 so that the aiming dot 40 is at the approximate center of the composite window 38. The aiming dot 40 is formed of a flat piece of metal and provides a point which the archer may align with the target.

A mounting piece 44 is attached to, or integral with, the upper portion of the front surface of the frame portion 18. The mounting piece 44 is preferably of cylindrical cross-section and extends upwardly and forwardly from the frame portion 18. A cylindrical aperture 46 extends through the mounting piece 44 and is adapted to receive a tie, elastic cord, spring, or the like (not shown) to tie the bow sight 10 to the body of the bow 14, thereby preventing axial rotation of the bow sight 10 away from the target.

In use, the bow sight 10 is mounted on the bow string 12 a desired, fixed distance above the nocking point 16. Mounting is accomplished by separating strands of the bow string 12 and inserting the bow sight 10 between the strands. When released, the strands engage the channels 26 on the outer surface edges 24 of the frame portion 18. The bow sight 10 is thereby secured at the desired position on the bow string 12. Viewing the target through the bow sight 10, the archer's line of sight passes through the composite window 38 formed by the open central area 20, the front central aperture 34 and the rear central aperture 36. The composite window 38 thus formed is of an elongated, somewhat elliptical shape and is relatively large with respect to the aiming dot 40 and to the bow sight 10. The aiming dot 40 is visible in the archer's line of sight within the composite window 38 and provides a point which the archer may align with the target. This combination of a large composite window 38 and a small aiming dot 40 is such that small movements of the archer or bow during aiming, while perhaps causing the target to "drift" from the aiming dot 40, will not cause the target to disappear from the archer's line of sight through the composite window 38. Thus, the archer may easily realign the target with the aiming dot 40 without looking away from the bow sight 10. In addition, the bright color of the aiming dot 40 increases sighting and targeting accuracy, especially in low light intensity environments. The use of a large composite window 38 also eliminates the necessity of precise boring or other formation of the sight opening at an angle with respect to the bow string because the bow sight 10 is operable even though the bow sight becomes somewhat vertically misaligned with respect to the target as the bow string is drawn so long as the aiming dot 40 is secured within the composite window 30 at an appropriate location.

The bow sight 10 may be constructed in an economical, efficient manner by securing the inserts 30, 32 and the arms 42 which support the aiming dot 40 within the frame portion 18 during the injection molding of the frame portion. In addition, the mounting piece 44 may also be formed as an integral part of the frame portion 18 during the injection molding step. Thus, the bow sight 10 may be simply and quickly formed by securing the inserts 30, 32 and arms 42 bearing the aiming dot 40 within a suitable die and injection molding the plastic material forming the frame portion 18 around the inserts 30, 32 and arms 42 to form the frame portion 18 and mounting piece 44 in a one-step process. The finished bow sight 10 may then be ejected from the die.

The principles of the invention are not limited to the specific bow sight 10 described herein. It will be apparent to those skilled in the art that modifications and variations of the above-described illustrative embodiment of the invention may be effected without departing from the spirit and scope of the novel concepts of the invention.

The embodiments of the invention in which an exclusive property or privilege is claimed are defined as follows:

1. A bow sight for use with a bow to provide targeting accuracy, the bow sight adapted to be mounted to a bow string and comprising:

a frame portion having front and rear surfaces and inner and outer edge surfaces, said outer edge surfaces having channels formed therein adapted to engage strands of said bow string, and said inner edge surfaces forming a relatively large open central area extending through said frame portion;

means imbedded within said frame portion for imparting rigidity and strength to said frame portion;

aiming means positioned within said open central area of said frame portion for locating a target within said open area; and securing means comprising arms connected to said frame portion for securing said aiming means within said open area.

2. A bow sight in accordance with claim 1 wherein said frame portion is of an elongated and substantially elliptical shape, and said open central area is slightly smaller than the said frame portion and is of a similar elongated and substantially elliptical shape.

3. A bow sight in accordance with claim 2 wherein said aiming means comprises a brightly colored flat metal piece of rectangular configuration.

4. A bow sight in accordance with claim 3 and further comprising a mounting piece having a cylindrical aperture extending therethrough adapted to engage a tie connecting said bow sight to a body of said bow.

5. A bow sight in accordance with claim 2 wherein said means for imparting rigidity and strength to said frame portion comprises:

a front insert means for imparting rigidity and strength to a forward portion of said frame portion and having a front central aperture extending therethrough, said front insert means being secured within a forward portion of said frame portion; and a rear insert means for imparting rigidity and strength to a rear portion of said frame portion and having a rear central aperture extending therethrough, said rear insert means being secured within a rear portion of said frame portion.

6. A bow sight in accordance with claim 5 wherein said front insert means comprises a flat metal piece of elongated and substantially elliptical shape, and said front central aperture is slightly smaller than said front insert means and is of a similar elongated and substantially elliptical shape.

7. A bow sight in accordance with claim 6 wherein said rear insert means comprises a flat metal piece of elongated and substantially elliptical shape, and said rear central aperture is slightly smaller than said rear insert means and is of a similar elongated and substantially elliptical shape.

8. A bow sight in accordance with claim 7 and further comprising a mounting piece having means adapted to engage a tie connecting said bow sight to a body of a bow and having a cylindrical aperture extending therethrough adapted to engage a tie connecting said bow sight to a body of siad bow.

9. A bow sight in accordance with claim 1 wherein said aiming means comprises a brightly colored, flat metal piece of rectangular configuration.

10. A bow sight in accordance with claim 1 and further comprising a mounting piece having means adapted to engage a tie connecting said bow sight to a body of a bow and having a cylindrical aperture extending therethrough adapted to engage a tie connecting said bow sight to a body of said bow.

11. A bow sight for use with a bow to provide targeting accuracy, said bow sight adapted to be mounted to a bow string and comprising:

a frame portion having front and rear surfaces and inner and outer edge surfaces having channels formed therein adapted to engage strands of said bow string, and said inner edge surfaces forming a relatively large open central area extending through said frame portion;

a front insert means having a front central aperture extending therethrough, said front insert means being secured within a front portion of said frame portion;

a rear insert means for imparting rigidity and strength to a rear portion of said frame portion and having a rear central aperture extending therethrough, said rear insert means being secured within a rear portion of said frame portion;

aiming means positioned within said open central area of said frame portion for locating a target within said open central area; and securing means comprising arms connected to said frame portion for securing said aiming means within said open area.

12. A bow sight in accordance with claim 11 wherein said front insert means comprises a flat metal piece of elongated and substantially elliptical shape, and said front central aperture is slightly smaller than said front insert means and is of a similar elongated and substantially elliptical shape.

13. A bow sight in accordance with claim 12 wherein said rear insert means is a flat metal piece of elongated and substantially elliptical shape, and said rear central aperture is slightly smaller than said rear insert means and is of a similar elongated and substantially elliptical shape.

14. A bow sight in accordance with claim 11 wherein said rear insert means is a flat metal piece of elongated and substantially elliptical shape, and said rear central aperture is slightly smaller than said rear insert means and is of a similar elongated and substantially elliptical shape.

15. A bow sight in accordance with claim 11 wherein said frame portion, said front insert means, and said rear insert means together define a composite window through which an archer may view a target.

16. A bow sight in accordance with claim 15 wherein said composite window is relatively large in size with respect to said aiming means.

17. A bow sight in accordance with claim 11 wherein said bow sight is formed by molding a plastic material in a die to form said frame portion.

18. A bow sight in accordance with claim 17 wherein said plastic material is molded around said means for imparting rigidity and strength to said frame portion and around said arms supporting said aiming means.

19. A method of forming a bow sight, said method comprising the steps of:

placing a flat metal piece of elongated and substantially elliptical shape having a front central aperture extending therethrough in a forward portion of a die;

placing a flat metal piece of elongated and substantially elliptical shape having a rear central aperture extending therethrough in a rear portion of a die;

placing arms which support a brightly colored flat metal piece of rectangular configuration in the same vertical plane as said front central aperture;

injection molding a plastic material into said die to form a bow sight having an open central area and a mounting piece; and ejecting said bow sight from said die.

* * * * *